United States Patent [19]

Siegal

[11] 4,392,430

[45] Jul. 12, 1983

[54] BASE-LOCK TYPE FONT HOLDER FOR IMPRINTING APPARATUS

[75] Inventor: Burton L. Siegal, Skokie, Ill.

[73] Assignee: Kiwi Coders Corporation, Wheeling, Ill.

[21] Appl. No.: 285,445

[22] Filed: Jul. 21, 1981

[51] Int. Cl.[3] ..... B41F 27/00

[52] U.S. Cl. ..... 101/381; 101/28

[58] Field of Search ..... 101/380, 381, 377, 370, 101/28, 29, 368, 327

[56] References Cited

U.S. PATENT DOCUMENTS

| | | | |
|---|---|---|---|
| 1,494,451 | 5/1924 | Van Vlissingen | 101/381 |
| 1,786,028 | 12/1930 | Pannier | 101/28 |
| 2,992,607 | 7/1961 | Gross | 101/28 |
| 3,187,665 | 6/1965 | Kingsley | 101/381 X |
| 4,239,002 | 12/1980 | Rasenstein | 101/377 |
| 4,252,061 | 2/1981 | Wade, Jr. | 400/175 X |

*Primary Examiner*—Clifford D. Crowder

*Attorney, Agent, or Firm*—Silverman, Cass & Singer, Ltd.

[57] ABSTRACT

A base-lock type font holder for imprinting apparatus of the impacting type, the holder comprising selectively spreadable aligned parallel rows of base lock segments which are clamped together within the outwardly opening cavity of a carrier body with the type font seated therein. An internally spring biased ratchet like arrangement facilitates both clamping and retention of the type font therein immovably during as many as several million impacts effected by the imprinting apparatus. The ratchet-like arrangement includes a pair of free-mounted miniature puck members seated at opposite ends of a coil spring, together seated in bearing relation to clamping screws employed to secure the segments within the cavity, and said screws being capable of manual manipulation against the spring bias selectively to spread or clamp said segments.

19 Claims, 5 Drawing Figures

BASE-LOCK TYPE FONT HOLDER FOR IMPRINTING APPARATUS

FIELD OF THE INVENTION

This invention relates generally to base-lock type font holders for imprinting apparatus, particularly of the impacting type, and more particularly provides a base-lock type font holder with vibration resistant clamping means for locking the flexible type font against loosening and/or dislodgement during high speed multiple impact operation.

The imprinting apparatus with which this invention primarily is concerned includes an imprinting head carrying a biased, releasably mounted flexible type font holder on which type font members releasably are secured. The imprinting head is drivably translated along a predetermined path in imprinting and return strokes, the imprinting stroke terminating with the impact of the type font carried by the imprinting head upon a surface upon which the indicia represented by the type font are applied. Apparatus of this general description involves substantial frequency of required maintenance, including frequent replacement of the type font arrangement carried by the type font holder.

Conventionally, flexible type font holders for imprinting apparatus for the impacting class are formed with an outwardly opening cavity for receiving plural thin, generally rectangular segments arranged on their sides in adjacent rows. Each segment has a longitudinally extending groove and a rounded longitudinal edge formation which is disposed facing outward of the cavity. The type font member(s) adapted to be secured in the base-lock arrangements have an enlarged base portion or portions in rib-like form capable of being introduced past the enlarged top portions into the cavities defined by the grooves between adjacent segments. Passages are formed in the bodies of said segments, said passageways being aligned when the segments are introduced in rows within the cavity of the holder body. Screw means threadably are engaged through the body and the aligned passages and tightened, tightly securing the segments in close array and clamping the type tightly.

Constructions as described have been found to experience loosening of the clamped array during continuous operation, where for example, a million or more impacts may be effected without replacement of the type font being mandated. If there is any loosening of the screws and/or segments, say as a result of vibrations or shock of repeated movement and impact, the type font will be dislodged. Smearing, misprints and undue wear on the type face are likely to result.

Further, the provision of effective clamping means without providing some indication when effective clamping pressure has been exerted can cause other problems. Effective clamping means should easily be manipulated so as to facilitate removal and replacement of the type font and the operator should be able easily to recognize when to cease manipulation of the fastening or clamping means. Once installed, the clamping effect should remain constant throughout use of the holder and the vibrations shock, etc. during operation of said apparatus should have no automatic loosening effect.

SUMMARY OF THE INVENTION

The invention provides a base-lock type font holder suitable for imprinting apparatus which holder includes a body having an outwardly opening cavity formed therein for receipt of plural rows of side by side parallel arranged base-lock segments, passageway means formed in each of said segments for alignment upon installation, passage means formed in said body for receiving clamping screws which are selected of length and configuration to pass through the passage means, across the cavity and through the aligned passageway means of the segments. At least one connecting bore is formed in the body along at least one side of the body axially taken normal to the axes of said passage means and communicating therewith. A communicating bore also is formed in said body communicating between said connecting bore and the exterior of said body. Spring-biased bearing means are seated in said connecting bore, said bearing means engaged against said clamping screws to prevent their independent, automatic or unassisted rotational movement of said clamping screws once set. Retaining ring means are provided for each screw and are carried in a groove formed on the screw and disposed between the wall of the cavity and the next adjacent segment to limit longitudinal movement of the screws during installation or retraction thereof as occasioned when the screws are purposely backed out, say for release and/or replacement of the type font.

DESCRIPTION OF THE PREFERRED EMBODIMENT

Figure 1:
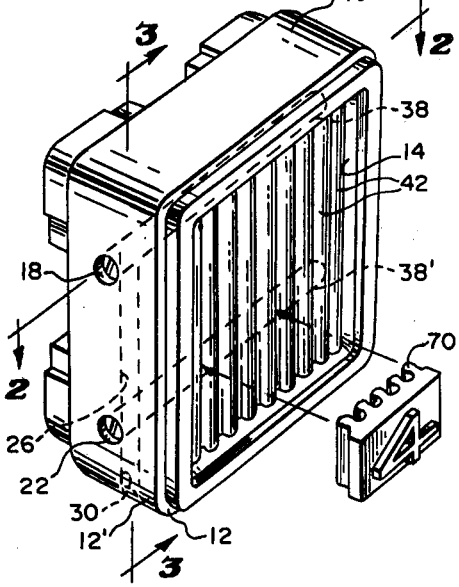
FIG. 1 is a perspective view of a type holder constructed in accordance with the invention herein.

The invention herein provides a type holder for use with the imprinting head of an impacting type imprinting device. Referring to the drawings, a type holder constructed in accordance with the invention is illustrated in FIG. 1. The type holder is formed as a generally rectangular body 10 preferably molded of plastic material.

Surrounding rim 12 defines outwardly opening cavity 14 of generally rectangular configuration having a planar floor 16. Opposite passageways 18, 20 and 22,24 are formed in rim portions 12' and 12''. The axes of passageway 18, 20 and 22,24 are common respectively.

Internally threaded rings 25 are set firmly into passageways 20 and 24. A connecting bore 26 is formed in the rim 12' communicating between passageways 18 and 22, the axis of said connecting bore 26 being normal to the axes of passageways 18, 20. A communicating bore 28 is formed in the body 10 linking the under surface of said body 10 with the connecting bore 26 at a location next adjacent passageway 22. An insertion bore 30 is formed in body 10 coaxial with connecting bore 26 and opens to the exterior of body 10.

An elongate coil spring 32 having freely mounted miniature pucks 34 seated at each end is fitted into the connecting bore 26 through insertion bore 30. The pucks 34 are each short lengths of cylindrical bar stock having short unitary axial projections 35 of substantially less diameter than the bar stock. The pucks 34 preferably each have flat end faces 36 adapted to interact with the flat sides 40 of the head of clamping screws 38. The projections 35 help center the pucks 34 relative to the spring 32; the diameter of the pucks 34 is about the same as the O.D. of the spring 32.

The individual base-lock segments 42 comprise a generally rectangular thin bar 44 preferably formed of plastic material, as by molding. Each segment 42 has a support portion 46 forming one longitudinal edge and a rounded formation 48 parallel thereto along opposite longitudinal edge. A groove 50 is formed in each of the opposite faces 52 of the segments 42 separating the rounded formation 48 from the support portion 46. Spaced passages 54 and 56 are formed in the support portion 46 of each segment 42. A pair of adjacent segments 42 define a chamber for receipt of the type font means.

The plural segments 42 are arranged for receipt in parallel rows within the cavity 14 of the holder body 10. The passages 54 and 56 are aligned with the passageways 18,20 and 22,24 respectively.

The clamping screws 38 are elongate generally cylindrical bar members having a threaded end 58 and an end grooved enlarged head 60 of generally polygonal cross-section. Preferably, the head 60 is of rectangular cross-section and has planar sides 40. A circumferential groove 62 is formed in the screw 38 next adjacent the enlarged head 60 for accomodating retaining rings 65 for a purpose to be explained hereinafter. The illustrated preferred structure of the enlarged rectangular head formation 60 has generally planar side surfaces with rounded corners 66.

When the segments 42 have been first introduced into the cavity 14. They are somewhat loose. The passages 18,20 are aligned with said passageways 54, respectively. One of the clamping screws 38 is introduced in passage 18. The segments are inserted into the cavity 14 side by side and the passages 54,56 thereof aligned respectively and with said passageways 18 and 20. The screw is urged further through the passages 54 and is engaged in the threaded ring carried by passage 20. A retaining ring 65 is then inserted radially into the now exposed groove 62. The spring 32 and pucks 34 then are installed within the connecting bore 26 through insertion bore 30. A rod-like implement, such as a paper clip end, is introduced into the communicating bore 28 and the adjacent puck engaged thereby to compress the spring and permit passage of a second like screw 38' through passage 22. The screw 38' then is urged through the aligned passage 22,56 and terminates in the threaded ring 25 of passage 24. (A retaining ring also is similarly mounted on screw 38').

The type font conventionally is flexible, preferably being formed of rubber-like material and includes a depending rib portion 70 adapted to be inserted between a pair of adjacent base lock segments 42, seated within the chamber 72 defined by the facing grooves 50. When the type font is introduced and placed in proper location, the first mentioned clamping screw 38 is manipulated, say by a screwdriver manually inserted in the groove carried on the end of head 60. The screw is rotated until a change in the apparent pressure required to rotate the screw 38 becomes perceivable. Then the second screw 38' is manipulated until a recognizable resistance is encountered in rotating the clamping screw. Tightening of screws 38,38' bring the segments 42 closer together diminishing the width of chamber 72, compressing the type base seated therein and hence securely clamping the type font in place.

Figure 2:
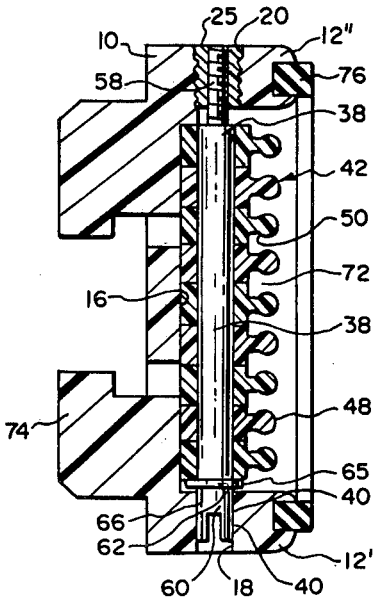
FIG. 2 is a sectional view of the type holder taken along the lines 2—2 of FIG. 1 and in the direction indicated.
Figure 3:
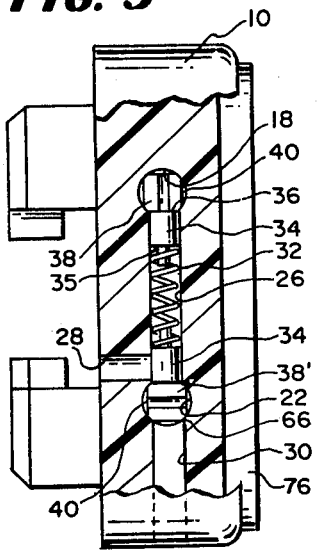
FIG. 3 is a sectional view taken along lines 3—3 of FIG. 1 and in the direction indicated.
Figure 4:
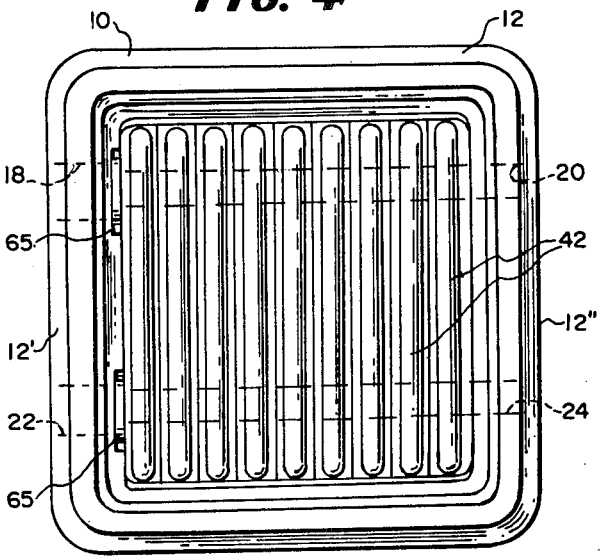
FIG. 4 is a plan view of the type holder of FIG. 1.
Figure 5:
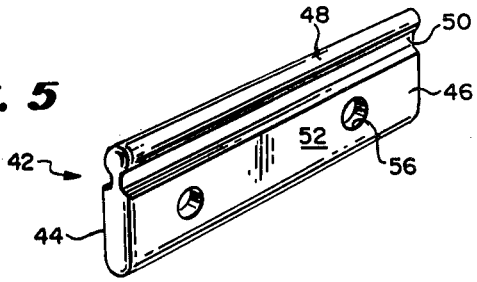
FIG. 5 is a perspective view of a base lock segment employed in the type holder of the invention.

The rotation of the screws 38,38', takes place against the bearing pressure of the flat surfaces 40 of the screw head formation with the puck ends 36 bearing against the adjacent flat surface 40 of respective screws 38, 38' represented in FIG. 2 particularly by reference character 60. The puck ends give a little against the spring bias, as the corners 66 bear against them and then they return when the next flat 40 is presented to them, by virtue of the constant force exerted by spring 32, the pucks prevent the automatic self rotation of the screws. Barring over exertion of manipulative pressure by manual rotation of the screws, prevention of excessive loosening is accomplished by the retaining rings 65 bearing against the inner wall of rim 12' when sufficient withdrawal of screws 38, 38' is accomplished. The operator "feels the resistance and thus has an indication that the proper loosening has been accomplished. The orientation of the spring 32 also is controlled and stabilized by the action of the pucks 34 and the passageway 26.

The clamping is performed by the action of the retaining rings against the segments. The assemblage of segments need only a small space between the end segments and the adjacent walls of the cavity to allow for sufficient spreading of the segments to accommodate the type font and to effect a tight securing relationship therewith when forced together during clamping. The illustrated type holder 10 is formed as a single molded piece with rearwardly extending portions 74 defining a set of intersecting slots adapted to cooperate with a spring-supported T-bar carried by the imprinting head. The rim 12 may be provided with a shallow groove in its outer face and a gasket or cushioning material 76 may be secured therein so as to establish a seal when the holder 10 is engaged with the ink cartridge. The face of the type font extends outwardly a very short distance greater than the gasket for impacting upon the package surface during imprinting.

Variations are capable of being made without departing from the spirit and scope of the invention as embodied in the appended claims.

What I claim is:

1. A base-lock type-font holder for use with an imprinting device comprising a body having an outwardly opening cavity of generally rectangular configuration and a peripheral rim surrounding said cavity, a plurality of base-lock segments each having at least a pair of transverse passages and arranged in parallel rows within said cavity with said passages thereof aligned coaxially, said rows of segments defining parallel type-font holding grooves, a pair of spaced passageways formed in each of a pair of opposite portions of said peripheral rim, screw means engaged through said passageways and passages of said segments, said screw means having a head portion at one end, said head portion being of a configuration defining opposite side surfaces, means carried by said screw means for clamping said segments tightly upon rotation of said screw means in one direction for securing the type-font within said holding grooves and in the opposite direction for releasing same, a connecting bore formed in one of said rim portions communicating between said adjacent passageways and resilient means within said connecting bore in bearing relationship with a facing side surface of said head portion of said screw means with force sufficient to bias said screw means against non-manipulated rotation particularly in said opposite direction.

2. The type holders as claimed in claim 1 wherein said means for clamping comprise said head portion being enlarged, said segments each having a pair of passages alignable with said passageways, said passages having a diameter smaller than said passageways and accommodating all but the enlarged head portion, rotation of said screw means in said one direction causing said head to bear against said segments to clamp same tightly for securing said type-font in said grooves and rotation in a direction opposite said one direction effecting loosening of said type-font.

3. The type holder as claimed in claim 1 wherein said means for clamping comprising a retainer ring carried by said screw means and engaging the outer one of said segments adjacent said one rim portion.

4. The type holder as claimed in claim 1 wherein said head portion has a polygonal configuration having rounded corners and said sides are generally planar.

5. The type holder as claimed in claim 1 wherein said head portion is enlarged at one end and has a threaded portion at its opposite end, threaded means seated within those of said passageways which are formed in the rim portion opposite to said one rim portion.

6. The type holder as claimed in claim 5 wherein said head has rounded corners and generally planar sides.

7. The type holder as claimed in claim 5 and a circumferential groove is formed in each screw adjacent to the head portion thereof and a snap-ring is seated in said groove, said snap-ring being disposed within said cavity and between the head portion and the segment next adjacent said one rim and capable of engaging same upon rotation of said screw means in said one direction.

8. The type holder as claimed in claim 1 wherein said resilient means comprise an elongate spring and a pair of cylindrical puck members seated at the ends of said spring, each puck member having an outwardly facing end surface engageable with the facing one of said side surfaces of the head portion of said screw means.

9. The type holder as claimed in claim 8 in which the side surface of the head is flat.

10. The type holder as claimed in claim 8 in which the spring is a coil spring.

11. The type holder as claimed in claim 10 in which the pucks seat within the ends of the spring.

12. The type holder as claimed in claim 10 in which the puck has an axial protrusion at one end and a bearing surface at the opposite end.

13. The type holder as claimed in claim 8 in which the spring is a coil spring and the diameter of the puck is about the same as the outer diameter of the spring.

14. The type holder as claimed in claim 1 in which a communicating bore is located next adjacent one of said passageways and the axis thereof is normal to the connecting bore.

15. The type holder as claimed in claim 1 and an insertion bore is formed in said holder body opening coaxially with said connecting bore for introducing said resilient means into said connecting bore.

16. The type holder as claimed in claim 1 in which a communicating bore is formed in said body communicating with said connecting bore, the axis thereof being normal to the axis of the connecting bore, said communicating bore adapted to receive a tool therein for urging said resilient means out of intersecting relationship with one of said passageways to enable said screw means to be introduced therein.

17. The type holder as claimed in claim 1 and said screw means comprise an elongate rod member having an enlarged head and an elongate cylindrical body terminating in a threaded portion and complementary threaded means in in those passageways carried by said opposite rim portion for receiving the threaded portion therein and said head portion has an enlarged polygonal cross-sectional configuration including planar sides capable of being engaged by said resilient means in bearing relationship thereto.

18. A printing type carrier for imprinting devices formed as a body of generally rectangular configuration having an outwardly opening cavity of generally rectangular configuration and an upstanding rim adjacent said cavity, base-lock segments arranged parallel in adjacent rows within the cavity, each of said segments having passages formed therein for axial alignment when installed within said cavity, two pair of aligned passageways in the body opening to the interior of the outwardly opening cavity and positioned for alignment with the aligned passages of said segments when same are installed, at least one internal connecting bore formed in said body communicating between the adjacent passageways on one side of the body, a coil spring disposed within said connecting bore and puck members disposed at each end of said coil spring, a pair of elongate screws, each having an enlarged head and a threaded leading end, said screw adapted to be passed through said passageway and the aligned passages of the segments and threadably engaged within the opposite passageway, each head of said screw having a generally polygonal cross-section and each screw carrying a circumferential groove proximate the head and a retaining ring is seated within said groove, rotation of said screws causing said segments to be forced together in clamping relationship with type font seated therebetween.

19. A base-lock type-font holder for use with an imprinting device comprising a body having an outwardly opening cavity of generally rectangular configuration and a peripheral rim surrounding said cavity, a plurality of base-lock segments, in parallel rows within said cavity to define parallel type-font holding grooves, a pair of spaced passageways formed in each of a pair of opposite portions of said peripheral rim, screw means engaged through said passageways and segments, means carried by said screw means for clamping said segments tightly upon rotation of said screw means in one direction for securing the type-font within said holding grooves and in the opposite direction for releasing same, a connecting bore formed in one of said rim portions communicating between said adjacent passageways, resilient means within said connecting bore in bearing relationship with said screw means whereby to bias said screw means against non-manipulated rotation, and a communicating bore formed in said body communicating with said connecting bore, the axis thereof being normal to the axis of the connecting bore, said communicating bore adapted to receive a tool therein for urging said resilient means out of intersecting relationship with one of said passageways to enable said screw means to be introduced therein.

* * * * *